US009970646B2

(12) United States Patent
Brnada et al.

(10) Patent No.: US 9,970,646 B2
(45) Date of Patent: May 15, 2018

(54) HEATSINK WITH INTEGRATED ELECTRICAL AND BASE CONTACTS

(71) Applicant: GE LIGHTING SOLUTIONS, LLC, East Cleveland, OH (US)

(72) Inventors: Josip Brnada, Willoughby, OH (US); Charles Leigh Huddleston, Cleveland, OH (US); William Stewart Johnson, Cleveland, OH (US)

(73) Assignee: GE LIGHTING SOLUTIONS, LLC, East Cleveland, OH (US)

( * ) Notice: Subject to any disclaimer, the term of this patent is extended or adjusted under 35 U.S.C. 154(b) by 256 days.

(21) Appl. No.: 14/850,010

(22) Filed: Sep. 10, 2015

(65) Prior Publication Data

US 2017/0074502 A1 Mar. 16, 2017

(51) Int. Cl.

| | |
|---|---|
| ***F21V 29/70*** | (2015.01) |
| ***F21V 23/06*** | (2006.01) |
| ***F21V 23/00*** | (2015.01) |
| ***F21K 9/90*** | (2016.01) |
| ***F21K 9/232*** | (2016.01) |
| ***F21K 9/68*** | (2016.01) |
| *F21Y 115/10* | (2016.01) |

(52) U.S. Cl.

CPC ..... *F21V 29/70* (2015.01); *F21K 9/232* (2016.08); *F21K 9/68* (2016.08); *F21K 9/90* (2013.01); *F21V 23/006* (2013.01); *F21V 23/06* (2013.01); *F21Y 2115/10* (2016.08)

(58) Field of Classification Search

CPC ..... F21V 29/004; F21V 29/70; F21V 23/002; F21V 23/006; F21V 23/007; F21V 23/06; F21Y 2101/02; F21Y 2103/10; H01L 2224/32225; H01L 2224/73265; H01R 31/06; H01R 33/94

See application file for complete search history.

(56) References Cited

U.S. PATENT DOCUMENTS

| | | | | |
|---|---|---|---|---|
| 5,547,392 A * | 8/1996 | Cheng | F21V 21/002 | 439/419 |
| 7,992,294 B2 | 8/2011 | Zaderej et al. | | |
| 8,038,329 B2 * | 10/2011 | Takahasi | F21V 3/00 | 362/264 |
| 8,272,766 B2 * | 9/2012 | Phipps | F21V 29/004 | 362/218 |
| 8,408,747 B2 * | 4/2013 | Wang | F21V 29/004 | 362/294 |

(Continued)

*Primary Examiner* — Hargobind S Sawhney

(74) *Attorney, Agent, or Firm* — Peter T. DiMauro; GE Global Patent Operation

(57) ABSTRACT

A heatsink having integrated electrical and base contacts for use with a light emitting diode (LED) light source. In some embodiments, a heatsink assembly for an LED lamp includes a first metallic heatsink component having a first wall portion and a first electrical contact, and a second metallic heatsink component having a second wall portion and a second, separate contact portion. A non-electrically conducting heatsink housing is configured to house the first wall portion and the second wall portion of the first and second heatsink components such that the first electrical contact extends from the non-electrically conducting heatsink housing and the second contact portion extends from the plastic housing in a manner to facilitate connection to hot and neutral lines of a power source.

21 Claims, 5 Drawing Sheets

(56) References Cited

U.S. PATENT DOCUMENTS

| | | | | |
|---|---|---|---|---|
| 2010/0026157 | A1* | 2/2010 | Tanaka | F21V 19/0055 313/45 |
| 2011/0001417 | A1* | 1/2011 | Stekelenburg | F21V 29/004 313/46 |
| 2011/0234080 | A1* | 9/2011 | Sanpei | H05K 1/056 313/113 |
| 2013/0044500 | A1* | 2/2013 | Reingruber | H05B 33/0803 362/382 |
| 2013/0162139 | A1* | 6/2013 | Liu | F21V 29/006 315/51 |
| 2013/0285530 | A1* | 10/2013 | Lin | F21V 23/06 313/51 |
| 2014/0240994 | A1* | 8/2014 | Lim | F21V 3/0445 362/382 |
| 2015/0098229 | A1* | 4/2015 | Tamura | F21V 23/007 362/382 |
| 2015/0103535 | A1* | 4/2015 | Hu | F21V 31/00 362/363 |
| 2015/0131293 | A1* | 5/2015 | Bucklen | F21V 29/773 362/294 |

* cited by examiner

HEATSINK WITH INTEGRATED ELECTRICAL AND BASE CONTACTS

FIELD OF THE INVENTION

The present disclosure generally relates to a heatsink having integrated electrical and base contacts. In some embodiments, two over molded stampings create an electrical and thermally conductive heatsink suitable for use with a light emitting diode (LED) light bulb.

BACKGROUND

Light emitting diodes (LEDs) are increasingly being used in lighting fixtures, and thus are a very important component of the lighting industry. LED lighting offers advantages over both incandescent and fluorescent lighting. For example, LED lighting is more energy efficient than incandescent bulbs and LED lighting does not have the cold temperature use and mercury issues of fluorescent light bulbs. In addition, the small size of the LEDs allows for creating light bulb packages in ways that incandescent and fluorescent lighting cannot be packaged.

LEDs produce heat which increases the temperature of the LED lighting devices, and if not properly dissipated such heat can reduce the performance and life of the LEDs. Therefore, one challenge to fully commercializing an LED lighting device is to provide a thermal management system that adequately removes heat generated by the LEDs in a cost effective manner. Conduction, convection and radiation are the three means of heat transfer, and therefore some manufacturers attach a heatsink to the LED lighting device in order to reduce the effect of detrimental heat. The heatsink provides a means for removing the energy from the LEDs of the lighting device through convection and radiation of the energy away from the LEDs.

Heat management in LED lighting devices that are becoming smaller, lighter, and more compact is an ever increasing challenge. Conventionally, the heatsink used to dissipate the energy has been made of metals, such as aluminum or copper, which can be machined, cast and/or extruded. In addition, the heatsink used in a particular LED lighting device must be configured so as not to short out signals and/or power being provided to the driver circuitry of the LED lighting device.

FIGS. 1A and 1B illustrate a conventional A19 form factor LED light bulb 100 which includes one or more LED light sources and associated electronic driver components (shown in FIG. 1B). The LED light bulb 100 includes a diffuser 102 connected to a heatsink portion 104, and a base 106 connected to a plastic housing 172 (shown in FIG. 1B). The base 106 is configured to fit into a standard household electrical socket, and includes a neutral connector 108 and a hot contact or tip 110.

FIG. 1B is an exploded view 150 of the conventional A19 form factor LED light bulb 100 of FIG. 1A. As shown, a metal core printed circuit board (MCPCB) 152 is positioned between the heatsink 104 and diffuser 102. The MCPCB contains a plurality of LED light sources 153A-153N situated about the outside edge of the MCPCB, and four LED light sources 153O-153R situated about the middle portion of the MCPCB for producing light output. A reflector 154 is shown positioned for connection to the MCPCB 152 via two self-threading screws 156 and 158. A driver board 160, which includes various electronic components 162 along with wires 164, 166, 168 and 170, is configured to fit within a plastic driver housing 172. As shown, the housing 172 is shaped and/or configured to fit within the heatsink 104, and is also designed to shield the wires 164, 166, 168 and 170 from being electrically short-circuited to the heatsink 104. As mentioned above, the base 106 is configured to fit onto the end of the housing 172, and includes the neutral connector 108 and a hot contact or tip 110.

Referring again to FIG. 1B, during assembly of the A19 LED light bulb the wires 164, 166, 168 and 170 are typically first attached to the driver board 160 and then positioned as shown for further assembly. The driver board 160 is then inserted into the housing 172 and the neutral wire 170 is bent into the slot 173 for connection to the neutral portion 108 of the base 106. In addition, the line wire 168 is positioned for connection to the tip 110 of the base 106. The base 106 is then connected to the plastic housing 172 in hot contact, and the base is then staked to the housing. During this process, care must be taken to ensure that the line wire 168 is in the correct position for attachment to the hot contact or tip 110. In addition, during further assembly, the wires 164 and 166 must be positioned in such manner to connect to the MCPCB 152 to provide power to the LED light sources without causing an electrical short-circuit by contact to the heatsink 104.

The numerous wire-handling operations described above make it difficult to automate the LED lamp assembly process, and can also lead to failures. For example, connection failures can occur between the base (or the driver) and some or all of the wires and the base may not be correctly and/or adequately fitted to the driver housing causing a base torsion failure. Thus, it would be desirable to simplify the wire connections, or eliminate such wire connections, from the LED lamp assembly process while still providing adequate heat dissipation properties.

SUMMARY OF THE INVENTION

Presented are apparatus and methods for providing a heatsink assembly for an LED lamp. In an embodiment, a first metallic heatsink component includes a first wall portion and a first electrical contact, and a second metallic heatsink component includes a second wall portion and a second, separate contact portion. Also included is a non-electrically conducting heatsink housing configured to house the first wall portion of the first metallic heatsink component and the second wall portion of the second metallic heatsink component. In this embodiment, the first electrical contact extends from the non-electrically conducting heatsink housing and the second contact portion extends from the plastic housing, which facilitates connection to hot and neutral lines of a power source.

In another advantageous embodiment, an LED lamp assembly includes an LED light source, an LED driver board operably connected to the LED light source, and a heat sink assembly in thermal communication with the LED light source and in electrical communication with the LED driver board. In this implementation, the heat sink assembly includes a first metallic heatsink component having a first wall portion and a first electrical contact, a second metallic heatsink component comprising a second wall portion and a second, separate contact portion, and a heatsink housing. The heatsink housing includes at least one electrically insulating portion configured to house the first wall portion of the first metallic heatsink component and the second wall portion of the second metallic heatsink component such that the first electrical contact of the first metallic heatsink component is in electrical contact with a base contact and the second, separate contact portion of the second metallic heatsink component is in electrical contact with a base neutral contact.

Another advantageous embodiment concerns a method for assembling an LED lamp. In particular, the process includes inserting a first metallic heatsink component having a first electrical contact into a non-electrically conducting housing, inserting a second metallic heatsink component having a second, separate contact into the non-electrically conducting housing, and inserting an LED driver board into an opening between the first and second metallic heatsink components such that a hot contact of the LED driver board contacts the first electrical contact of the first metallic heatsink component and a neutral contact of the LED driver board contacts the second, separate contact of the second metallic heatsink component. Lastly, the method includes electrically connecting a printed circuit board (PCB) comprising at least one LED light source to the LED driver board.

BRIEF DESCRIPTION OF THE DRAWINGS

Features and advantages of some embodiments, and the manner in which the same are accomplished, will become more readily apparent with reference to the following detailed description taken in conjunction with the accompanying drawings, which illustrate exemplary embodiments (not necessarily drawn to scale), wherein.

DETAILED DESCRIPTION

Embodiments described herein relate to LED lighting devices, and in particular to providing a novel heatsink assembly which advantageously simplifies assembly of LED lamps. Some embodiments of the apparatus and processes described herein also make it easier to automate LED lamp assembly.

Accordingly, in some embodiments an integrated heatsink assembly for an LED lamp includes a first metallic heatsink component having a first wall portion, which may be curved, and alternating current (AC) hot contact. A second metallic heatsink component includes a second wall portion, which may also be curved, and an AC neutral contact portion. In addition, in an embodiment a plastic heatsink housing is provided that is configured to accept the curved first wall portion of the first metallic heatsink component and the curved second wall portion of the second metallic heatsink component. The plastic heatsink housing includes an aperture in a distal end to accommodate the AC hot contact of the first metallic heatsink component, and also has an opening in a lower side portion to accommodate the AC neutral contact portion of the second metallic heatsink component. In some implementations, the plastic housing includes one or more dividers to electrically isolate the first metallic heatsink component from the second metallic heatsink component.

Figure 1A:
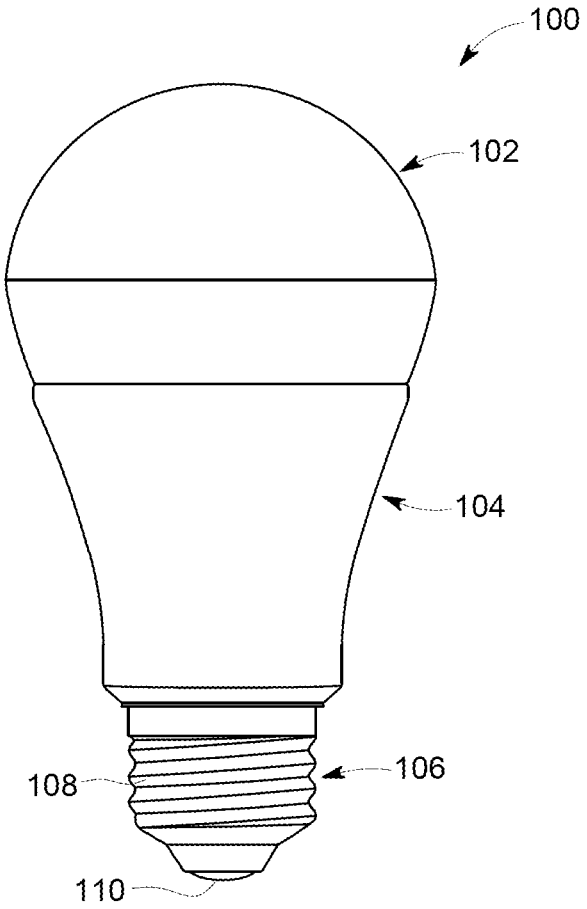
FIG. 1A illustrates a conventional A19 form factor LED light bulb having one or more LED light sources.
Figure 1B:
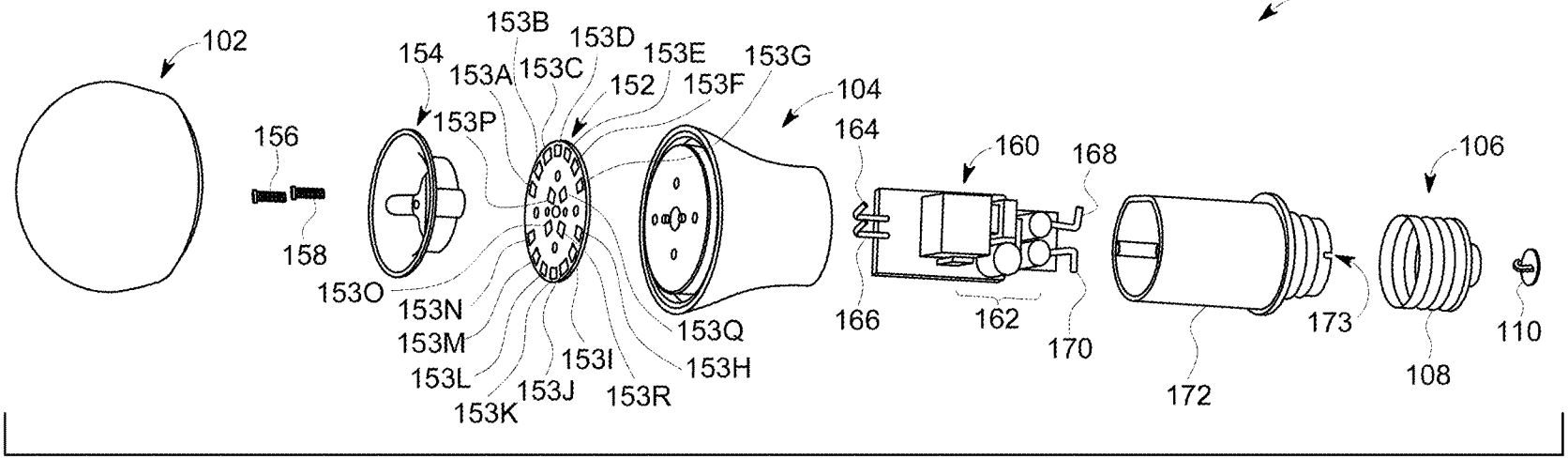
FIG. 1B is an exploded view of the conventional A19 form factor LED light bulb 100 of FIG. 1A.
Figure 2A:
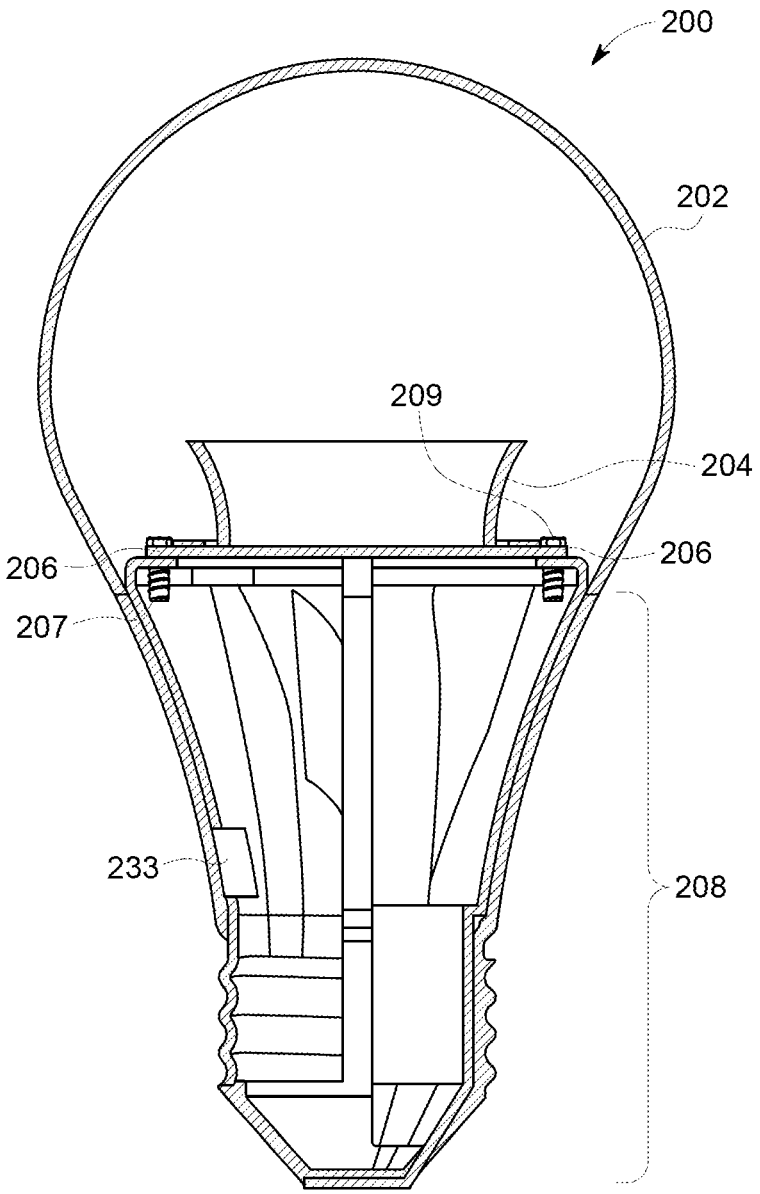
FIG. 2A is a cutaway side view of an embodiment of an LED lamp assembly that includes an integrated heatsink assembly in accordance with novel aspects of the disclosure.

FIG. 2A is a cutaway side view of an embodiment of an LED lamp assembly 200 that includes an integrated heatsink with base contacts and electrical connections in accordance with novel aspects disclosed herein. In particular, an A-line LED lamp is shown that includes a diffuser 202, a reflector 204 connected to a printed circuit board (PCB) 206, which may be a metal core printed circuit board (MCPCB), that includes the LED light source(s) (not shown), and the heatsink assembly portion 208 (which will be explained in detail below). In this implementation, all of the driver components are on the PCB 206, and the metal heatsink parts deliver alternating current (AC) directly to the LED board and driver combination via fasteners, tabs or another electrical connection method, wherein the driver components transform the AC to DC for during operation of the LED lamp. In addition, fasteners 207 and 209 mechanically connect the PCB 206 to the heatsink assembly portion 208, and may also function to anchor the reflector 204 to the PCB 206. It should be understood that the LED lamp assembly 200 can be formed into many other shapes and/or sizes, and therefore the location and/or types of the various components shown in FIG. 2A may be different in other embodiments.

Figure 2B:
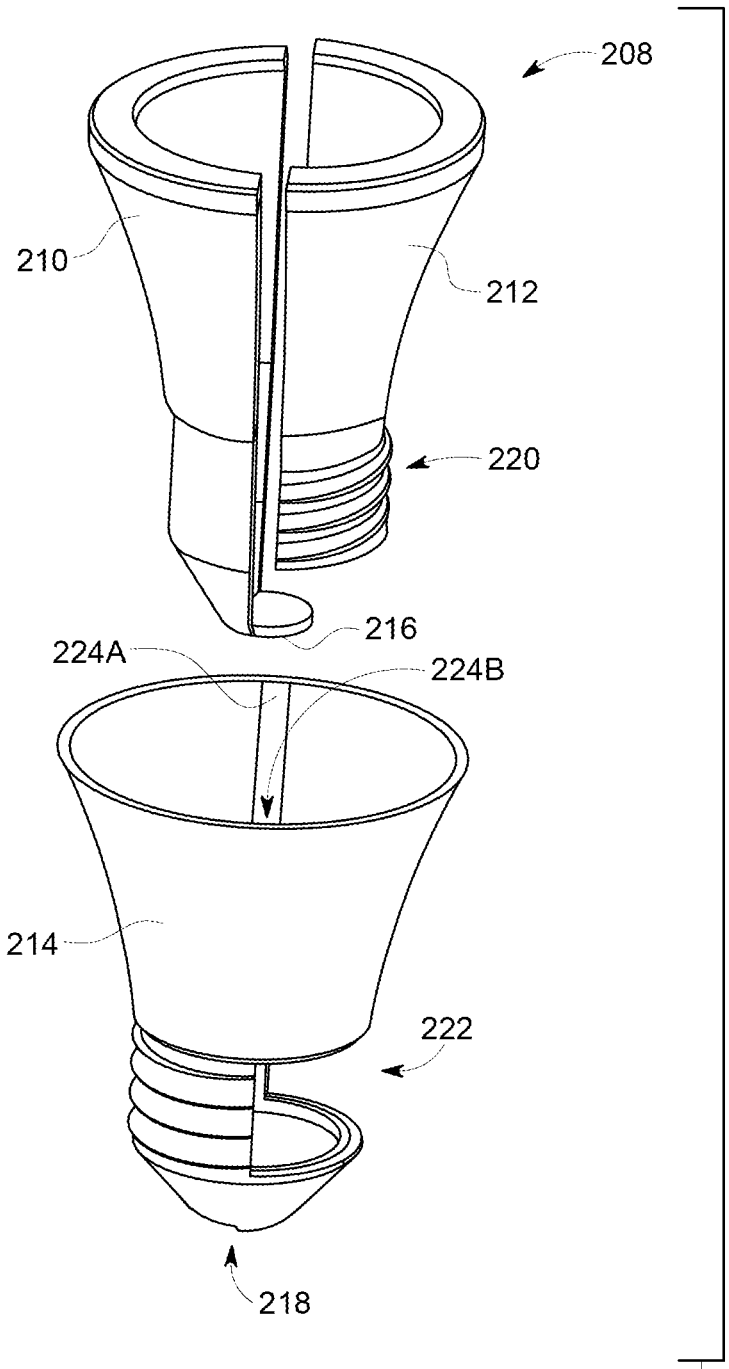
FIG. 2B is an exploded view of the integrated heatsink assembly shown in FIG. 2A.

FIG. 2B is an exploded view of the heatsink assembly 208 illustrated by FIG. 2A. In some embodiments, the heatsink assembly 208 includes a first metallic component 210, a second metallic component 212, and a plastic housing component 214. The first and second metallic components 210 and 212 may be composed of two stampings (which may be nickel-plated or could be of other platings) that are over molded to create an electrical and thermally conductive heatsink. As shown, the first and second metallic components 210 and 212 may be configured for insertion into the plastic housing component 214 during assembly. In some embodiments, the first metallic component 210 includes an alternating current (AC) hot contact 216 configured to fit through an aperture 218 in the bottom of the plastic housing component 214 during assembly. In addition, the second metallic component 212 includes an AC neutral connector 220 configured to fit through an opening 222 of the plastic housing component 214 during assembly. In some embodiments, the plastic housing component 214 may be made of a thermoplastic material that is "V-0" rated, wherein the designation V-0 relates to a "Standard for Safety of Flammability of Plastic Materials for Parts in Devices" promulgated by Underwriters Laboratories™. The V-0 designation means that when the material is tested regarding flammability in a vertical position, it is capable of self-extinguishing within ten seconds after the ignition source is removed.

Referring again to FIG. 2B, the plastic housing component 214 may also include interior divider portions 224A and 224B. The divider portions are designed to separate the first metallic component 210 from the second metallic components 212 when the metallic components are inserted therein. Thus, when the LED lamp 200 is powered ON, the divider portions 224A and 224B electrically isolate the metallic components 210 and 212 from each other.

Figure 2C:
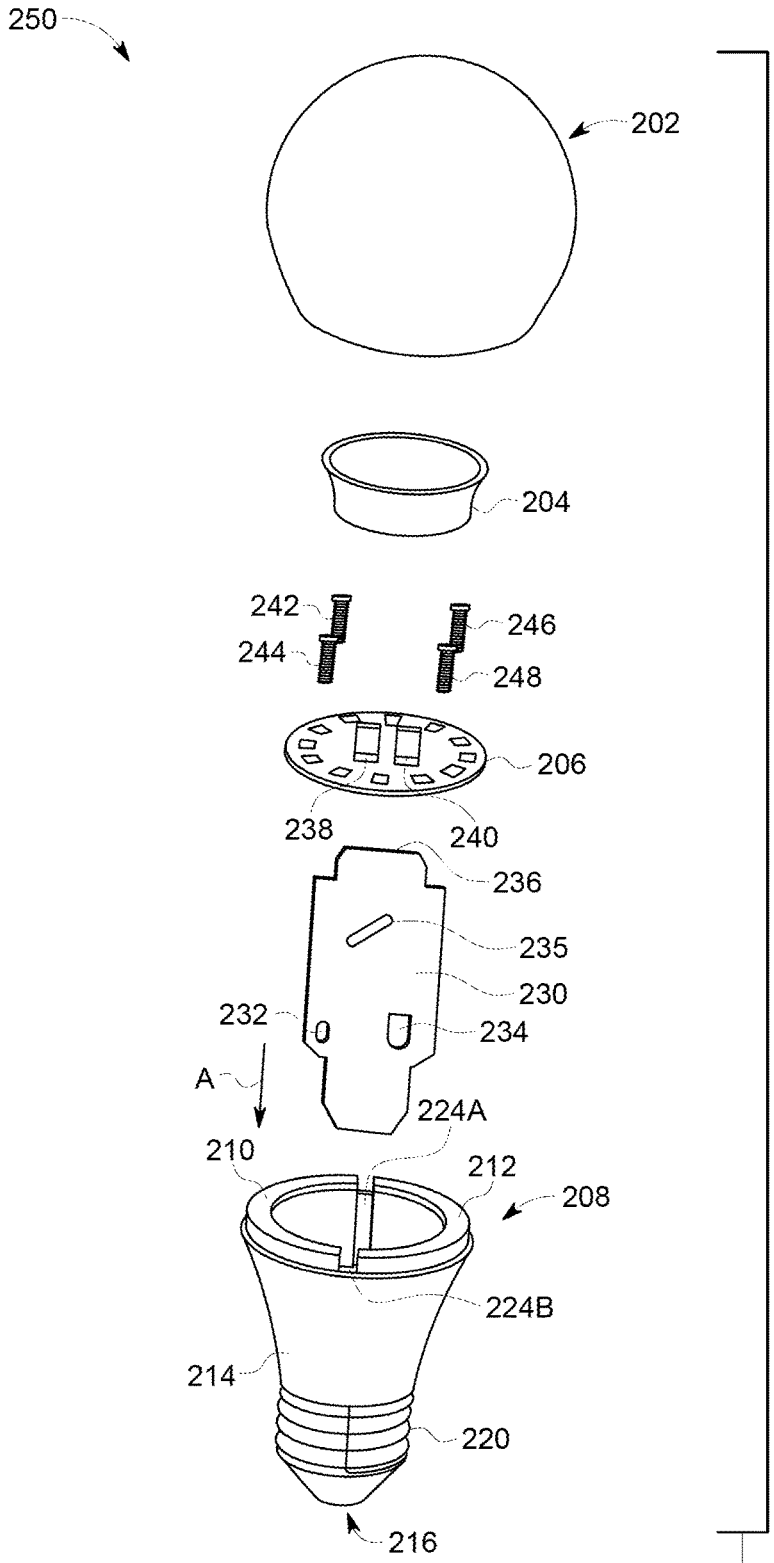
FIG. 2C is an exploded view of an LED lamp assembly which includes a separate driver and an integrated heatsink assembly in accordance with novel aspects of the disclosure.

FIG. 2C is an exploded view 250 of an LED lamp assembly which includes the integrated heatsink assembly 208 and a separate driver 230 in accordance with novel aspects disclosed herein. As shown, the heatsink assembly 208 includes a first metallic component 210 and a second metallic component 212 which have been inserted into the plastic housing component 214. The first and second metallic components 210 and 212 are separated by the divider portions 224A and 224B so as to be electrically isolated from each other. In addition, the alternating current (AC) hot contact 216 of the first metallic component 210 has been inserted through the aperture in the bottom of the plastic housing component 214, and the AC neutral connector 220 of the second metallic component 212 has been inserted through the opening of the plastic housing component 214. A separate driver board 230 is configured for connection directly to the heatsink assembly, and the includes a first hole 232, a second hole 234 and a third hole 235 that facilitate potting material flow from side to side. The separate driver board 230 connects to the LED PCB board 206 via connectors 238, 240, and 236, and functions to transform the alternating current (AC) to direct current (DC) when the LED lamp is in operation. Utilizing such a separate driver board configuration is advantageous because more space is available for driver components, which can be placed on both sides of the driver board 230. In addition, the driver components can be located away from the LED PCB board 206. However, such an assembly may be more difficult to manufacture in comparison to an assembly with an integrated driver and LED PCB board, and thus may add to the cost of manufacture.

In separate drive board configurations like that shown in FIG. 2C, the LED driver board 230 includes LED driver circuitry (not shown), and in some embodiments is configured and sized to be easily inserted downwards (in the direction of arrow "A") to contact alignment ridges (for example, curved rectangular tab 233 shown in FIG. 2A) or other features within the heatsink assembly 208 so that the hot connector 232 contacts a portion (not shown) of the first metallic component 210, and the neutral connector 234 contacts a portion (not shown) of the second metallic component 212. The LED driver board 230 may be made of a Composite Epoxy Material (CEM), which is a composite material that typically has a woven glass fabric surface and a non-woven glass core combined with epoxy synthetic resin (which are materials typically used in printed circuit boards), or FR-4, which is composite material composed of woven fiberglass cloth with an epoxy resin binder that is flame resistant. There are different types of CEMs, and in some embodiments the LED driver board 230 is composed of CEM-3, which is white in color and is flame retardant.

Referring again to FIG. 2C, also depicted are the diffuser 202, the reflector 204 and the metal core printed circuit board (MCPCB) 206 which includes the LED light source(s) and could contain driver circuitry. In some embodiments, the MCPCB 206 includes a slot (not shown) configured to accommodate the tab 236 of the LED driver board 230 so that the tab 236 can be engaged during assembly by a first Surface Mount Technology (SMT) connector 238 and a second SMT connector 240. Also shown are fours threaded fasteners 242, 244, 246 and 248 (such as metallic screws) for thermally connecting the MCPCB 206 to the first and second metallic components 210 and 212 of the heatsink assembly 208 (but more or less fasteners could be used). In some embodiments, the threaded fasteners (or other connection features, such as snap connector features) also directly connect the MCPCB 206 to the AC line connection and to the AC neutral connection. Accordingly, in some embodiments the threaded fasteners or screws (or other types of fasteners) may be utilized to thermally and mechanically connect the MCPCB to the heatsink, and also may be used to affix the reflector 204 to the PCB 206.

As illustrated by FIGS. 2A to 2C, assembly of an LED light bulb in accordance with the novel aspects described avoids having to attach wires to a driver board, and avoids having to position those wires during assembly so that one wire fits into a neutral wire slot while another is positioned to connect to the base. In addition, in contrast to prior art LED bulb assembly processes, there is no need to place a base on a housing, or to press a tip into hot contact with the bottom of the base, or to stake the base to a housing.

In some embodiments, after the LED driver board 230 has been inserted into the heatsink assembly 208, a thermally-conductive silicone potting material 304 is deposited therein to fill the spaces or voids between the electronic components of the LED driver board 230 and the metallic components 210 and 212 of the heatsink. It should also be noted that, in some other embodiments, the potting material 304 may be deposited in such manner to only partially fill the interior volume of the heatsink assembly 208, but is deposited in enough quantity to ensure that heat from the various electrical components is thermally carried to at least some portions of the metallic components of the heatsink to adequately dissipate heat to prevent overheating.

The technical advantages of the heatsink assembly embodiments described herein include ease of assembly, increased reliability and, for some implementations, the opportunity to automate assembly. Heatsink assemblies in accordance with the novel aspects described herein provide adequate thermal dissipation characteristics for LED lamps, and can be utilized in a variety of different and/or diverse applications, for example, to provide LED light bulbs of different sizes for different applications that are easier and thus less expensive to manufacture than conventional LED light bulbs. Furthermore, the disclosed heatsink assemblies can be modified and/or changed and for use with LED lamps that have other types of electrical connectors, such as GU24 LED lamps that have bayonet mount or bi-pin connectors, in addition to different types of LED lamps having screw bases (for example, E12-type LED lamps and E26-type LED lamps). Furthermore, the heatsink assemblies described herein could be modified to accommodate LED lamps that connect directly to a DC source (and thus do not require driver circuitry to transform AC to DC). In addition, the heatsink assemblies described herein could be modified to accommodate LED lamps that connect to other types of energy sources, such as a high frequency AC source (but this particular example would require driver circuitry).

It should be understood that the above descriptions and/or the accompanying drawings are not meant to imply a fixed order or sequence of steps for any process referred to herein; rather any process may be performed in any order that is practicable, including but not limited to simultaneous performance of steps indicated as sequential.

Although the present invention has been described in connection with specific exemplary embodiments, it should be understood that various changes, substitutions, and alterations apparent to those skilled in the art can be made to the disclosed embodiments without departing from the spirit and scope of the invention as set forth in the appended claims.

What is claimed is:

1. A heatsink assembly for an LED lamp comprising:

a first metallic heatsink component comprising a first wall portion and a first electrical contact;

a second metallic heatsink component comprising a second wall portion and a second, separate neutral contact portion; and a plastic housing configured to house the first wall portion of the first metallic heatsink component and the second wall portion of the second metallic heatsink component such that the first electrical contact extends from the plastic housing and the second contact portion extends from the plastic housing in a manner to facilitate connection to hot and neutral lines of a power source.

2. The heatsink of claim 1, wherein the hot contact comprises one of an alternating current (AC) hot contact and direct current (DC) contact.

3. The heatsink assembly of claim 1, wherein the non-electrically conducting heatsink housing further comprises divider portions configured to electrically isolate the first metallic heatsink component from the second metallic heatsink component.

4. The heatsink assembly of claim 1, wherein the non-electrically conducting heatsink housing is comprised of a plastic material.

5. An LED lamp assembly comprising:

an LED light source;

an LED driver board operably connected to the LED light source; and a heat sink assembly in thermal communication with the LED light source and in electrical communication with the LED driver board, wherein the heat sink assembly comprises:

a first metallic heatsink component comprising a first wall portion and a first electrical contact;

a second metallic heatsink component comprising a second wall portion and a second, separate contact portion; and a heatsink housing comprising at least one electrically insulating portion configured to house the first wall portion of the first metallic heatsink component and the second wall portion of the second metallic heatsink component such that the first electrical contact of the first metallic heatsink component is in electrical contact with a base hot line contact and the second, separate contact portion of the second metallic heatsink component is in electrical contact with a base neutral contact.

6. The LED lamp assembly of claim 5, further comprising a diffuser component adhered to the heat sink housing and enclosing the LED light source.

7. The LED lamp assembly of claim 5, further comprising a reflector operable to direct light from the LED light source.

8. The LED lamp assembly of claim 5, further comprising potting material thermally connecting components of the LED driver board to the first and second metallic heatsink components.

9. An LED lamp assembly comprising:

an LED light source and LED driver assembly; and a heat sink assembly in thermal communication with the LED light source and LED driver board assembly, and in electrical communication with the LED driver board, wherein the heat sink assembly comprises:

a first metallic heatsink component comprising a first wall portion and a first hot line electrical contact;

a second metallic heatsink component comprising a second wall portion and a second, separate neutral contact portion; and a heatsink housing comprising at least one electrically insulating portion configured to house the first wall portion of the first metallic heatsink component and the second wall portion of the second metallic heatsink component such that the first electrical contact of the first metallic heatsink component is in electrical contact with a base hot line contact and the second, separate contact portion of the second metallic heatsink component is in electrical contact with a base neutral contact.

10. The LED lamp assembly of claim 9, further comprising a diffuser component adhered to the heat sink housing and enclosing the LED light source and LED driver assembly.

11. The LED lamp assembly of claim 9, further comprising a reflector operable to direct light from the LED light source.

12. The LED lamp assembly of claim 9, further comprising potting material thermally connecting components of the LED lamp and LED driver board assembly to the first and second metallic heatsink components.

13. The LED lamp assembly of claim 9, further comprising a housing overmolded over the first metallic heatsink component and the second metallic heatsink component.

14. A method for assembling an LED lamp comprising:

inserting a first metallic heatsink component having a first electrical contact into a non-electrically conducting housing;

inserting a second metallic heatsink component having a second, separate contact into the non-electrically conducting housing;

inserting an LED driver board into an opening between the first and second metallic heatsink components such that a hot contact of the LED driver board contacts the first electrical contact of the first metallic heatsink component and a neutral contact of the LED driver board contacts the second, separate contact of the second metallic heatsink component; and electrically connecting a printed circuit board (PCB) comprising at least one LED light source to the LED driver board.

15. The method of claim 14, further comprising connecting a reflector to the PCB to encircle and outwardly reflect light from the at least one LED light source.

16. The method of claim 14, further comprising adhering a diffuser to a rim of the non-electrically conducting housing to cover the at least one LED light source.

17. The method of claim 14, further comprising, after inserted the LED driver board, depositing a potting material into an interior volume between components of the LED driver board and the first and second metallic heatsink components in enough quantity to ensure that heat from the various electrical components is thermally carried to at least some portions of the first and second metallic heatsink components to dissipate heat.

18. A method for assembling an LED lamp comprising:

inserting a first metallic heatsink component having a first electrical contact into a non-conducting housing;

inserting a second metallic heatsink component having a second, separate contact into the non-conducting housing; and inserting an LED lamp and LED driver printed circuit board (PCB) assembly into an opening between the first and second metallic heatsink components such that a hot contact of the LED lamp and LED driver PCB assembly contacts the first electrical contact of the first metallic heatsink component and a neutral contact of the LED lamp and LED driver PCB assembly contacts the second, separate contact of the second metallic heatsink component.

19. The method of claim 18, further comprising connecting a reflector to the LED lamp and LED driver PCB to encircle and outwardly reflect light from the at least one LED light source.

20. The method of claim 18, further comprising adhering a diffuser to a rim of the non-conducting housing to cover the at least one LED light source of the LED lamp and LED driver PCB.

21. The method of claim 18, further comprising, after inserted the LED lamp and LED driver PCB, depositing a potting material into an interior volume between components of the LED lamp and LED driver PCB and the first and second metallic heatsink components in enough quantity to ensure that heat from the various electrical components is thermally carried to at least some portions of the first and second metallic heatsink components to dissipate heat.

* * * * *